US008596239B2

(12) United States Patent
Escriva et al.

(10) Patent No.: US 8,596,239 B2
(45) Date of Patent: Dec. 3, 2013

(54) CYLINDER HEAD OF AN INTERNAL COMBUSTION ENGINE COMPRISING A COOLING CIRCUIT

(75) Inventors: Jérôme Escriva, Paris (FR); Bruno Blanc, Bruell-en-Vexin (FR); Hervé Pohier, Le Plessis-Trévlse (FR); Norbert Lartigue, Le Plessis-Robinson (FR)

(73) Assignee: Société de Motorisations Aéronautiques, Bourges (FR)

( * ) Notice: Subject to any disclaimer, the term of this patent is extended or adjusted under 35 U.S.C. 154(b) by 281 days.

(21) Appl. No.: 13/013,412

(22) Filed: Jan. 25, 2011

(65) Prior Publication Data

US 2011/0220043 A1 Sep. 15, 2011

(30) Foreign Application Priority Data

Jan. 26, 2010 (FR) ..... 10 50511

(51) Int. Cl.

| | |
|---|---|
| ***F02F 1/42*** | (2006.01) |
| ***F02F 1/10*** | (2006.01) |
| ***F02F 3/14*** | (2006.01) |
| ***F02F 1/14*** | (2006.01) |
| ***F02F 1/36*** | (2006.01) |
| ***F01M 3/04*** | (2006.01) |
| ***F01P 9/02*** | (2006.01) |
| ***F01P 3/02*** | (2006.01) |
| ***F01P 3/14*** | (2006.01) |
| ***F01P 1/06*** | (2006.01) |

(52) U.S. Cl.

USPC ..... 123/193.5; 123/196 M; 123/41.17; 123/41.72; 123/41.75; 123/41.76; 123/41.79; 123/41.8; 123/41.82 R; 123/41.82 A; 123/41.85

(58) Field of Classification Search

USPC ..... 123/193.5, 196 M, 41.17, 41.72, 41.75, 123/41.76, 41.79, 41.8, 41.82 R, 41.82 A, 123/41.85

See application file for complete search history.

(56) References Cited

U.S. PATENT DOCUMENTS 2,078,499 A * 4/1937 Ljungstrom ..... 123/41.42
2,085,810 A * 7/1937 Ljungstrom ..... 123/41.42

(Continued)

FOREIGN PATENT DOCUMENTS

AT 006 295 U1 7/2003
DE 38 29 339 C1 12/1989

(Continued)

OTHER PUBLICATIONS

International Seaich Report as issued for PCT/FR2009/051841.
Bockris J. O'M et al.; "On the splitting of water", International Journal of Hydrogen Energy, Elsevier Science Publishers B.V., Barking, GB, vol. 10, No. 3, Jan. 1, 1985, pp. 179-201.
French Search Report dated Sep. 24, 2010.

*Primary Examiner* — Lindsay Low
*Assistant Examiner* — Charles Brauch
(74) *Attorney, Agent, or Firm* — Pillsbury Winthrop Shaw Pittman LLP

(57) ABSTRACT

A cylinder head of an internal combustion engine in which a cooling circuit is arranged, suited for a coolant circulation, includes a peripheral duct surrounding an exhaust valve seat and a peripheral duct surrounding an inlet valve seat communicating by means of a connecting duct; the cylinder head including a first coolant inlet, a second coolant inlet, and an outlet for heated coolant, the second inlet communicating with the connecting duct.

8 Claims, 2 Drawing Sheets

(56) References Cited

U.S. PATENT DOCUMENTS

| | | | | | |
|---|---|---|---|---|---|
| 2,914,045 | A | * | 11/1959 | Hill | 123/41.72 |
| 4,169,488 | A | * | 10/1979 | Goloff et al. | 137/340 |
| 4,364,339 | A | * | 12/1982 | Fricker et al. | 123/41.42 |
| 4,522,161 | A | * | 6/1985 | Slee | 123/41.85 |
| 4,593,655 | A | * | 6/1986 | Mezger | 123/41.77 |
| 4,708,095 | A | * | 11/1987 | Luterek | 123/41.42 |
| 5,673,560 | A | * | 10/1997 | Hope | 60/606 |
| 6,769,383 | B2 | * | 8/2004 | Doers et al. | 123/41.82 R |
| 7,384,619 | B2 | * | 6/2008 | Bar-Gadda | 423/579 |
| 2004/0265137 | A1 | | 12/2004 | Bar-Gadda | |
| 2009/0000578 | A1 | * | 1/2009 | Reustle | 123/41.82 R |

FOREIGN PATENT DOCUMENTS

| | | | |
|---|---|---|---|
| DE | 10 2004 030 717 | A1 | 1/2006 |
| EP | 0 967 628 | A2 | 12/1999 |
| FR | 2583250 | | 12/1986 |
| WO | WO 02/097245 | | 12/2002 |
| WO | WO 2005/005009 | | 1/2005 |

* cited by examiner

Coupe A-A'

Coupe B-B'

CYLINDER HEAD OF AN INTERNAL COMBUSTION ENGINE COMPRISING A COOLING CIRCUIT

CROSS-REFERENCE TO RELATED APPLICATIONS

This application is based upon and claims the benefit of priority from French Patent Application No. 1050511, filed Jan. 26, 2010, the entire content of which is incorporated herein by reference.

The present invention concerns a cylinder head of an internal combustion engine comprising a cooling circuit, in particular by oil.

The field of the invention is that of internal combustion engines cooled by a circuit of oil, and in particular that of engines used in the field of aeronautics.

The invention concerns more particularly the cooling by oil of a cylinder head and of the valve seats of an internal combustion engine.

Internal combustion engines generally comprise a combustion chamber formed by a cylinder in which a piston slides according to a regular rectilinear movement. This rectilinear movement is then transformed into rotation by means of a rod connecting the piston to a crankshaft.

Each cylinder is closed in its upper part by a cylinder head comprising at least two valves:

- an inlet valve permitting the admission of combustive air in the combustion chamber via an inlet duct arranged in the cylinder head;
- an exhaust valve permitting the evacuation of the burnt gases from the combustion chamber towards the exhaust via an exhaust duct also arranged in the cylinder head.

Generally, the cylinder head also comprises at least two valve seats, an inlet seat and an exhaust seat, on which the valves come in contact in their position of rest so as to isolate the ducts from the combustion chamber.

The valve seats play an important role in internal combustion engines. Indeed, if the seat/valve contact is not perfect, i.e. if there is a poor position of the valves on the seat or a machining fault of the seats, leakages can appear at the level of the valves, damaging the compression ratio of the engine, and hence its efficiency, its power, its level of emission of pollutant gases and also its lifetime.

During the functioning of the engine, the piston compresses the air/fuel mixture injected into the combustion chamber, with a view to causing it to explode; the initiation of the combustion can be carried out by a spark in the case of a controlled ignition engine or by auto-ignition as a function of the cylinder pressure.

The thermal energy resulting from the explosion is transformed into mechanical energy, thus permitting the piston to have an alternating rectilinear movement in the cylinder between a high position and a low position.

Owing to the explosion of the air/fuel mixture in the combustion chamber of the engine, the piston, the valve seats and the cylinder head are subjected to powerful thermal stresses, these parts being directly in contact with the mixture of inflamed gas in the chamber.

The valve seats are subject to great thermal stresses, and in particular the exhaust valve seats which are not cooled by fresh air, unlike the inlet valve seats which are cooled by the air during the admission cycle.

Thus, during the functioning of the engine, the temperature of the cylinder head is in the order of 220° C., whereas the temperature of the valve seats can reach almost 400° C.

So as to protect the different elements constituting the engine, it is therefore necessary to provide cooling for these parts.

The cooling of the cylinder head, and in particular the part in contact with the mixture of inflamed gas, is ensured by a circulation of oil around the two valve seats of the cylinder head.

The cooling oil typically circulates in a circuit realized in particular by two distinct machinings: the machining of a first groove on the cylinder head side and the machining of a second groove on the valve seat side, the oil circuit being formed during assembly by shrink fitting of the valve seats in the cylinder head.

However, the known circuits for cooling by oil do not allow the cylinder head and the valve seats to be cooled sufficiently. Furthermore, the distribution of the cooling is not optimized at the hottest points of the cylinder head and the valve seats, which limits the lifetime of the parts.

In this context, the invention aims to solve the above-mentioned problems and to propose a cylinder head of an internal combustion engine comprising a cooling circuit which allows the cooling of the cylinder head and of the valve seats to be improved by an optimized cooling circuit.

To this end, the invention proposes a cylinder head for an internal combustion engine in which a cooling circuit is arranged which is suited for coolant circulation, the said cylinder head comprising:

- an exhaust duct opening out on a circular exhaust cavity comprising on its periphery an annular peripheral groove,
- an exhaust valve seat assembled in the said circular exhaust cavity, the said exhaust valve seat comprising an annular peripheral groove arranged on its periphery; the said annular peripheral groove of the circular exhaust cavity and the said annular peripheral groove of the said exhaust valve seat constituting a peripheral duct suited for the circulation of the said coolant around the said exhaust valve seat by the assembly of the said exhaust valve seat in the said circular exhaust cavity;
- an inlet duct opening out on a circular inlet cavity comprising on its periphery an annular peripheral groove;
- an inlet valve seat assembled in the said circular inlet cavity, the said inlet valve seat comprising an annular peripheral groove arranged on its periphery; the said annular peripheral groove of the circular inlet cavity and the said annular peripheral groove of the said inlet valve seat constituting a peripheral duct suited for the circulation of the said coolant around the said inlet valve seat by the assembly of the said inlet valve seat in the said circular inlet cavity;

the said cylinder head being characterized in that

- the said peripheral duct surrounding the said exhaust valve seat and the said peripheral duct surrounding the said inlet valve seat communicate by means of a connecting duct;
- the said cylinder head comprises a first coolant inlet, a second coolant inlet, and an outlet for heated coolant, the said second inlet communicating with the said connecting duct.

The invention is particularly well suited to internal combustion engines comprising a dedicated cylinder head for each cylinder of the engine, such as for example aircraft engines. However, the invention is also applicable to internal combustion engines comprising a single cylinder head covering the whole of the cylinders of the engine, such as for example motor vehicle engines.

According to an advantageous form of the invention, the coolant is oil cooling.

Owing to the invention, the efficiency of the cooling, in particular by oil, of the cylinder head and more particularly of the added exhaust valve seat is improved by proposing a cooling circuit having a first coolant inlet and a second coolant inlet bringing cold coolant at the level of a connecting duct positioned between the inlet seat and the exhaust seat. The inlet of cold fluid thus allows the coolant to be cooled before its entry in the peripheral duct surrounding the exhaust valve seat.

Advantageously, the efficiency of the cooling of the cylinder head, and in particular of the exhaust valve seat, can be improved by combining at the second coolant inlet at least one optimized exchange surface, for example of undulating form, thus allowing at the level of the peripheral ducts the optimization of the heat exchanges between the parts and the coolant whilst the engine is in operation.

Owing to the invention, the cylinder head of the engine, and more particularly the exhaust valve seat, are better cooled in operation, which guarantees an improvement to the lifetime of such parts.

The cylinder head according to the invention can also have one or more of the following characteristics, considered individually or according to all technically possible combinations:

- the said annular peripheral groove surrounding the said exhaust valve seat comprises a section of undulating shape formed by a first recess, a boss and a second recess;
- the said annular peripheral groove of the said circular exhaust cavity has a section of hemicircular shape or of undulating shape formed by the alternating of a first recess, a boss and a second recess;
- the said peripheral duct surrounding the said exhaust valve seat has a variable section around the said exhaust valve seat;
- the said section of the said peripheral duct surrounding the said exhaust valve seat varies between 24 $mm^2$ and 36 $mm^2$ around the said exhaust valve seat;
- the said annular peripheral groove surrounding the said inlet valve seat comprises a section of undulating shape suited to the passage of the said coolant, the said section being formed by a first recess, a boss and a second recess;
- the said annular peripheral groove of the said circular inlet cavity has a section of hemicircular shape or of undulating shape formed by the alternating of a first recess, a boss and a second recess;
- the said peripheral duct surrounding the said inlet valve seat has a variable section around the said inlet valve seat;
- the said section of the said peripheral duct surrounding the said inlet valve seat varies between 6 $mm^2$ and 21 $mm^2$ around the said inlet valve seat.

Other characteristics and advantages of the invention will emerge more clearly from the description thereof given below, by way of indication and in no way restrictive, with reference to the attached figures, in which:

In all the figures, the common elements bear the same reference numbers unless specified otherwise.

FIG. 1 illustrates a perspective view of a cylinder head 10 of an internal combustion engine, such as an engine used in the field of aeronautics.

Figure 1:
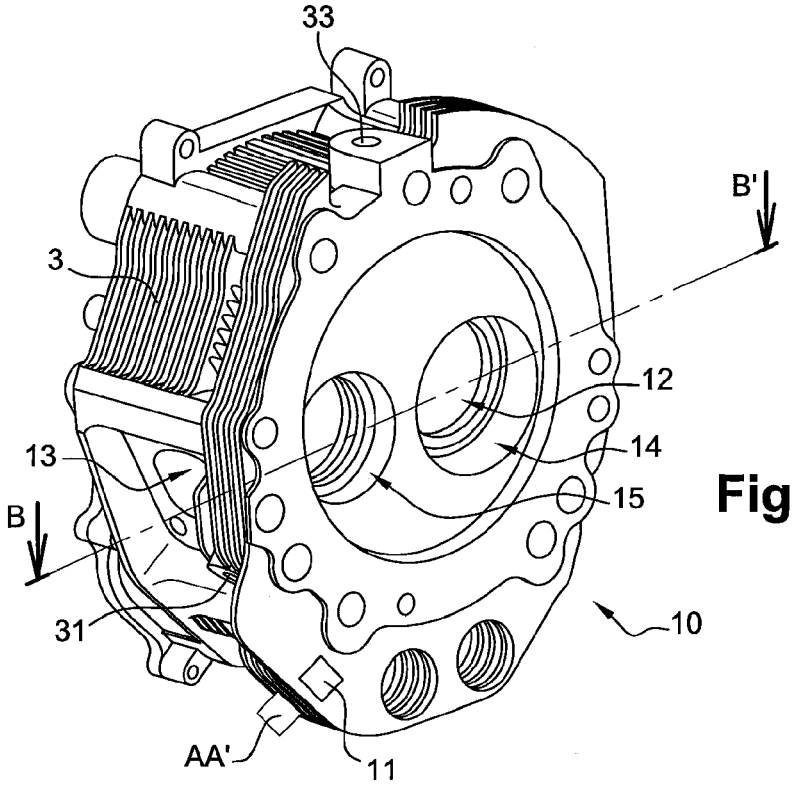
FIG. 1 illustrates a perspective view of a cylinder head of an internal combustion engine according to the invention (the valve seats not being represented in this figure, to allow better clarity)
Figure 2:
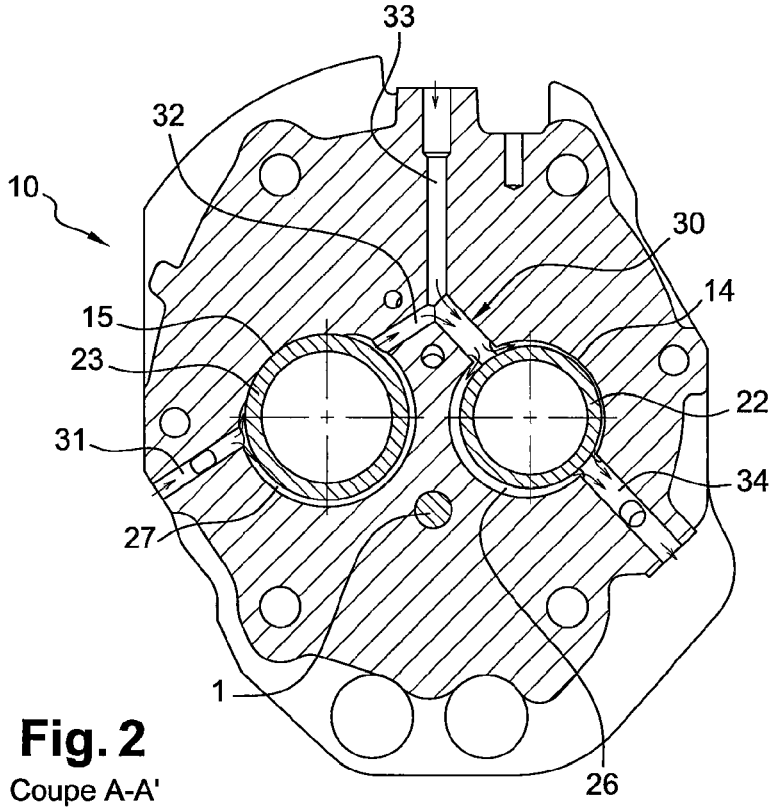
FIG. 2 illustrates a view in section according to a first plane AA' illustrated in FIG. 1 of a cylinder head according to the invention comprising the valve seats and showing a cooling circuit.

FIG. 2 is a view in section of the cylinder head 10 according to a first section plane AA' substantially parallel to the joint plane 11 of the cylinder head 10, represented in FIG. 1.

Figure 3:
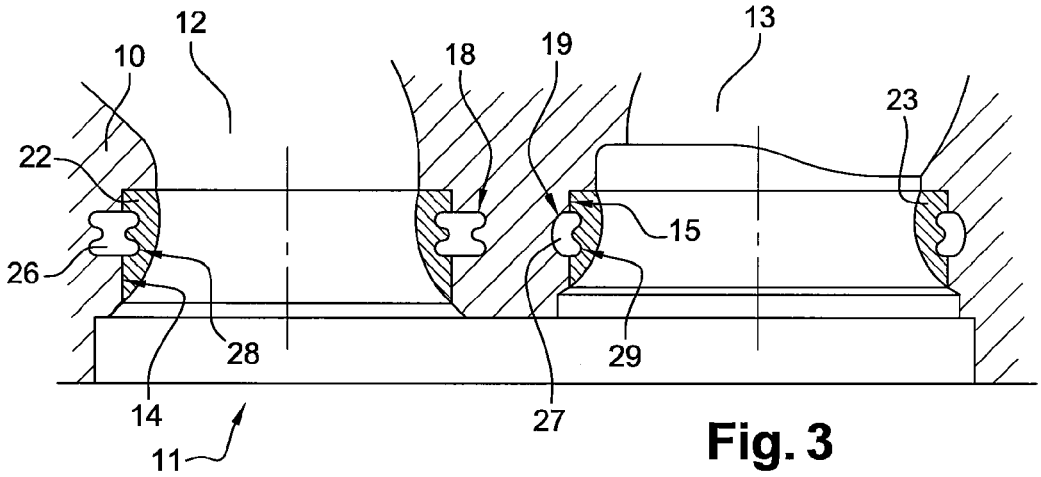
FIG. 3 illustrates a second view in section according to a second plane BB' illustrated in FIG. 1 of a cylinder head according to the invention comprising the valve seats.

FIG. 3 is a second view in section of the cylinder head 10 according to a second section plan BB' illustrated in FIG. 1, showing the sections of the circular inlet and exhaust ducts in which the coolant circulates around the valve seats.

The cylinder head 10 which is illustrated corresponds to a cylinder head of an internal combustion engine in which each cylinder of the engine comprises a dedicated cylinder head.

The cylinder head 10 is suited to close the upper part of a combustion chamber (not shown) formed by a cylinder in which a piston slides so as to vary the volume of the combustion chamber. To this effect, the support face 11 of the cylinder head 10 represents the joint plane between the cylinder head 10 and the engine block (not shown) comprising the combustion chamber.

The cylinder head 10 comprises:

- an inlet duct 13 passing through the cylinder head 10, opening out on an inlet valve gage 15 forming a circular cavity facing the combustion chamber (not shown);
- an exhaust duct 12 also passing through the cylinder head 10 and opening out on an exhaust valve gage 14 forming a circular cavity facing the combustion chamber (not shown).

The inlet duct 13 allows the combustion chamber to be supplied with a mixture of combustion air by means of an inlet valve (not shown) which is movable between an open position allowing the admission of the combustive air in the combustion chamber, and a closed position in which the inlet valve rests against an inlet valve seat 23.

The exhaust duct 12 is suited to evacuate the burnt gases resulting from the combustion in the combustion chamber by means of an exhaust valve (not shown) which is movable between an open position allowing the escape of the burnt gases towards the exhaust pipe, and a closed position, in which the exhaust valve rests against an exhaust valve seat 22.

The valve seats 22, 23 are respectively shrink-fitted in the valve gages 14, 15 and comprise a substantially conical internal profile at the level of their end situated facing the combustion chamber on which the valve comes to rest when it is in the closed position.

The cylinder head 10 is cooled by air by means of a plurality of cooling fins 3 and by a coolant, typically oil, by means of a cooling circuit 30 arranged in the cylinder head 10 and surrounding in particular the valve seats 22, 23; the cooling circuit 30 allows the hottest zones of the cylinder head 10 to be cooled which are in contact with the mixture of inflamed gas in the combustion chamber.

The cooling circuit 30, or oil circuit, allows a cooling of the cylinder head to be ensured, in particular around the inlet seat 23 and the exhaust seat 22 by the circulation of the cooling oil.

Around the valve seats 22, 23, the oil circuit 30 is formed by the assembly of a first annular groove 19, 18 machined respectively inside the inlet valve gage 15 and the exhaust valve gage 14 and of a second annular groove 29, 28 machined respectively on the periphery of the inlet valve seat 23 and on the periphery of the exhaust valve seat 22.

Thus, on assembly by shrink-fitting of the valve seats 22, 23 inside the valve gages 14, 15 of the cylinder head, the association of the annular grooves 18, 19 of the chambers 14, 15 with the annular grooves 28, 29 of the valve seats 22, 23 forms peripheral ducts 26, 27 around the valve seats 22, 23 in which the cooling oil circulates so as to cool the valve seats 22, 23 and the cylinder head 10.

FIG. 2 illustrates in particular the whole of the oil circuit 30 passing through the cylinder head 10. The oil circuit 10 comprises

- a first cooling oil inlet duct 31 allowing a "cold" cooling oil to be conveyed up to the peripheral duct 27 surrounding the inlet seat 23;
- a bent connecting duct 32 connecting the peripheral inlet duct 27 to the peripheral exhaust duct 26 surrounding the exhaust seat 22, the connecting duct 32 being connected to a second inlet duct 33 for "cold" cooling oil;
- an outlet duct 34 allowing the evacuation of the "hot" cooling oil heated in contact with the walls of the cylinder head 10 and the valve seats 22, 23.

The direction of circulation of the cooling oil within the cooling circuit is represented by a series of arrows in FIG. 2.

In order to correctly cool the valve seats 22 and 23 and more particularly the exhaust valve seat 22 undergoing the highest thermal stresses, the peripheral duct 26 of the oil circuit 30 around the exhaust valve seat 22 comprises a larger oil passage section than the peripheral duct 27 surrounding the inlet valve seat, thus allowing the flow of cooling oil to be increased around the exhaust seat.

In addition, the oil circuit 30 comprises a second oil inlet 33 which, combined with the optimized section of the peripheral duct 26, allows the flow of oil circulating in the peripheral exhaust duct 26 to be increased.

The second cooling oil inlet 33 allows the temperature of the oil in the circuit 30 to be reduced by the introduction of a "colder" oil than the oil originating from the upstream circuit 30 heated on contact with the walls of the inlet valve seat 23 and the cylinder head 10. Thus, the second cooling oil inlet 33 allows the optimization of the efficiency of the cooling of the exhaust seat 22 and of the cylinder head 10 around the exhaust seat 22.

When the engine is in operation, the temperature of the cylinder head 10 is not homogeneous; it varies as a function of the proximity to the combustion chamber. Thus, the hottest zone of the cylinder head 10 is situated substantially between the exhaust duct 12 and the inlet duct 13, the hottest point being symbolized in FIG. 2 by the hatched zone with reference number 1. The temperature of the cylinder head 10 in the vicinity of this zone 1 is in the order of 220° C. On the other hand, the valve seats reach a temperature in the order of 400° C. close to this zone 1.

In order to homogenize the temperature of the cylinder head 10 around the valve seats 22, 23 and to advantageously cool the hottest zones, the peripheral ducts 26, 27 comprise oil passage sections which vary around the valve seat as a function of the hot zones and the cold zones of the cylinder head 10. Thus, the peripheral ducts 26, 27 according to the invention have a larger section close to the zone 1 allowing the oil passage volume and also the heat exchange surface to be increased. This section variation of the peripheral ducts 26, 27 on the periphery of the valve seats 22, 23 in particular allows the homogenizing of the temperature of the cylinder head 10 and of the valve seats 22, 23, avoiding the presence of a large temperature difference in the cylinder head.

The hot zone is understood to mean the zones of the cylinder head reaching a temperature substantially in the order of 200° C. The cold zone is understood to mean the zones of the cylinder head reaching a temperature substantially in the order of 100° C.

Thus, according to an advantageous form of the invention, the section of the peripheral inlet duct 27 allowing the circulation of the cooling oil around the inlet valve seat 23 varies between 6 $mm^2$ and 21 $mm^2$ around the inlet valve seat 23. The largest section of the peripheral inlet duct 27 is situated close to the hottest zones of the cylinder head 10 and of the inlet valve seat 23, as illustrated in FIG. 2.

According to the advantageous form of the invention, the section of the peripheral exhaust duct 26 allowing the circulation of the cooling oil around the exhaust valve seat 22 varies between 24 $mm^2$ and 36 $mm^2$ around the exhaust valve seat 22. The largest section of the peripheral exhaust duct 26 is situated close to the hottest zones of the cylinder head 10 and of the exhaust valve seat 22, as illustrated in FIG. 2.

The section values of the peripheral ducts 26, 27 are given by way of indication and are not restrictive with regard to the embodiment described.

The peripheral exhaust duct 26 comprises a larger oil passage section than the oil passage section of the peripheral inlet duct 27, thus allowing a larger cooling capacity of the exhaust seat to be obtained, the exhaust seat bearing the greatest thermal stresses during the operation of the engine.

Figure 4:
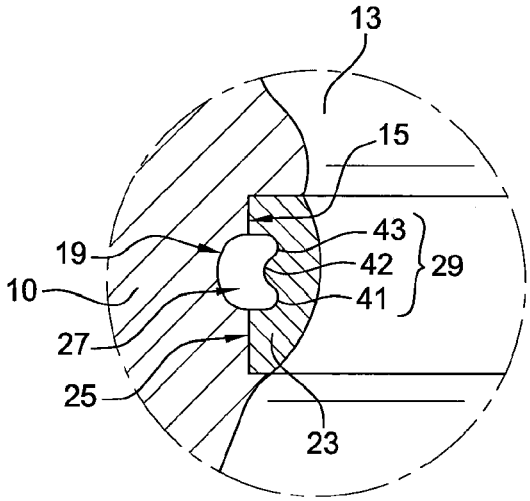
FIG. 4 illustrates in more detail the circuit for cooling by oil of the cylinder head according to the invention at the level of the inlet valve.
Figure 5:
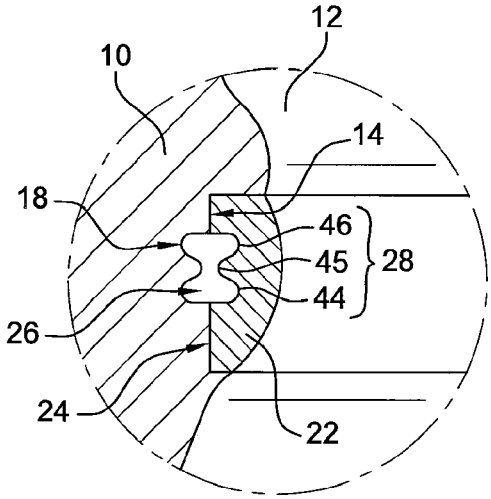
FIG. 5 illustrates in more detail the circuit for cooling by oil of the cylinder head according to the invention at the level of the exhaust valve.

FIGS. 4 and 5 are detailed views of FIG. 3 illustrating more precisely the sections of the peripheral inlet 27 and exhaust 26 ducts in which the cooling oil circulates around the valve seats 22, 23.

The peripheral inlet duct 27 is formed by the combination of the annular peripheral groove 29 of the inlet valve seat and of the annular groove 19 of the inlet valve gage 15 of the cylinder head 10. The peripheral exhaust duct 26 is formed by the combination of the annular peripheral groove 28 of the exhaust valve seat and of the annular groove 18 of the exhaust valve gage 14 of the cylinder head 10.

The inlet valve seat 23, illustrated in FIG. 4, comprises an annular peripheral groove 29 machined on the periphery 25 of the inlet valve seat 23, the section of which has an undulating shape.

The undulating shape of the section is substantially in a wave shape or else a sinusoidal undulation, formed by a first recess 41, or hollow, realized by a retreat of material with respect to the surface of the periphery 25, followed by a boss 42 projecting with respect to the first recess 41, and by a second recess 43, or hollow, likewise realized by a retreat of material with respect to the surface of the periphery 25. Typically, the annular groove 29 comprises a section of undulating shape comprising a succession of a recess, a boss and a second recess at a height of a few millimetres, advantageously at a height of 6 mm.

Thus, according to the illustrated embodiment of the invention, the section of the annular groove 29 is formed by a recess of circular shape, a boss of circular shape and by a second recess of circular shape of the same radius, advantageously according to a radius of 1 mm.

According to an advantageous form of the invention, the first recess 41 of circular shape and the second recess 42 of circular shape are aligned such that they have an equivalent depth with respect to the surface of the periphery 25.

The section of the annular groove 19 of the inlet chamber 15 of the cylinder head 10 is formed by a recess of hemicircular shape, the diameter of which is equivalent to the height of the annular groove 29, i.e. 6 mm according to the illustrated embodiment.

The exhaust valve seat 22, illustrated in FIG. 5, comprises an annular peripheral groove 28, the section of which also has an undulating or wave shape, machined on the periphery 24 of the exhaust valve seat 22.

In a similar manner to the annular peripheral groove 29 of the inlet valve seat 23 described above, the undulating shape of the section of the annular groove 28 is substantially in the shape of a wave, or else of a sinusoidal undulation, formed by a first recess 44, or hollow, realized by a retreat of material with respect to the surface of the periphery 24, followed by a boss 45 projecting with respect to the first recess 44, and by a second recess 46, or hollow, likewise realized by a retreat of material with respect to the surface of the periphery 24. Typically, the annular groove 28 comprises a section of undulating shape comprising a succession of a recess, a boss and a second recess at a height of a few millimetres, advantageously at a height of 6 mm.

Thus, according to the illustrated embodiment of the invention, the section of the annular groove 29 is formed by a recess of circular shape, a boss of circular shape and by a second recess of circular shape of the same radius, advantageously according to a radius of 1 mm.

According to an advantageous form of the invention, the first recess 44 of circular shape and the second recess 46 of circular shape are aligned such that they have an equivalent depth with respect to the surface of the periphery 24.

The annular groove 18 of the exhaust valve gage 14 of the cylinder head 10 also has a section of undulating shape similar to the annular grooves 28, 29 of the valve seats 22, 23.

Thus, the machining of an annular groove with a section having an undulating shape solely at the level of the valve seat, as represented in FIG. 4, allows the heat exchange surface to be increased between the oil and the parts which are to be cooled by at least 60% with respect to the annular grooves comprising a linear profile.

Owing to the invention, the machining of an annular groove with a section having an undulating shape at the level of the valve seat and at the level of the cylinder head, as represented in FIG. 5, allows the heat exchange surface to be increased between the oil and the parts which are to be cooled by at least 80% with respect to the annular grooves comprising a linear profile.

Thus, the profile of the section of the annular groove 18, 19 of the valve gage 14, 15 of the cylinder head 10 can be equally well a profile of undulating shape or a profile of hemicircular shape, the choice of the profile being determined as a function of the desired cooling.

According to an advantageous form of the invention, the variation of the sections of the peripheral ducts 26, 27 is realized by a dissymmetrical machining of the annular grooves 18, 19 solely on the periphery of the circular valve gages 14, 15 of the cylinder head 10. The machining is realized particularly such that the circular valve gages 14, 15 of each valve seat has a dissymmetry evolving in particular as a function of the hot points and of the cold points of the cylinder head and of the valve seats.

Thus, owing to the invention, the efficiency of the cooling of the cylinder head and of the valve seats is improved by increasing the surfaces for heat exchange with the coolant of the cooling circuit according to an optimized undulating profile.

The passage sections of coolant are also optimized on the periphery of the valve seats so as to guarantee an optimum speed of flow of oil around the seats.

The charge losses are optimized.

The invention has been described in particular with a section of the annular groove of the inlet valve seat and a section of the annular groove of the exhaust valve seat having an undulating shape comprising a first recess, a boss, and a second recess; however, the annular grooves of the valve seats can also have a section of hemicircular, or other, shape.

The invention claimed is:

1. A cylinder head of an internal combustion engine in which a cooling circuit is arranged, suited for a coolant circulation, the cylinder head comprising:

an exhaust duct opening out on a circular exhaust cavity comprising on its periphery an annular peripheral groove;

an exhaust valve seat assembled in said circular exhaust cavity, said exhaust valve seat comprising an annular peripheral groove arranged on its periphery, said annular peripheral groove of the circular exhaust cavity and said annular peripheral groove of said exhaust valve seat constituting a peripheral duct suited for the circulation of said coolant around said exhaust valve seat by the assembly of said exhaust valve seat in said circular exhaust cavity;

an inlet duct opening out on a circular inlet cavity comprising on its periphery an annular peripheral groove;

an inlet valve seat assembled in said circular inlet cavity, said inlet valve seat comprising an annular peripheral groove arranged on its periphery, said annular peripheral groove of the circular inlet cavity and said annular peripheral groove of said inlet valve seat constituting a peripheral duct suited for the circulation of said coolant around said inlet valve seat by the assembly of said inlet valve seat in said circular inlet cavity;

wherein said peripheral duct surrounding said exhaust valve seat and said peripheral duct surrounding said inlet valve seat communicate with each other using a connecting duct, wherein said peripheral duct surrounding said exhaust valve seat has a cross-sectional area perpendicular to a direction of flow of said coolant in said duct that is variable along said peripheral duct around said exhaust valve seat, and wherein said cylinder head comprises a first coolant inlet, a second coolant inlet, and an outlet for heated coolant, said second inlet communicating with said connecting duct.

2. The cylinder head of an internal combustion engine according to claim 1, wherein said annular peripheral groove surrounding said exhaust valve seat comprises a section of undulating shape formed by a first recess, a boss and a second recess.

3. The cylinder head of an internal combustion engine according to claim 1, wherein said annular peripheral groove of said circular exhaust cavity has a section of hemicircular shape or of undulating shape formed by the alternating of a first recess, a boss and a second recess.

4. The cylinder head of an internal combustion engine according to claim 1, wherein said cross-sectional area of said peripheral duct surrounding said exhaust valve seat varies between 24 $mm^2$ and 36 $mm^2$ around said exhaust valve seat.

5. The cylinder head of an internal combustion engine according to claim 1, wherein said annular peripheral groove surrounding said inlet valve seat comprises a section of undulating shape suited for the passage of said coolant, said section being formed by a first recess, a boss and a second recess.

6. The cylinder head of an internal combustion engine according to claim 1, wherein said annular peripheral groove of said circular inlet cavity has a section of hemicircular shape or of undulating shape formed by the alternating of a first recess, a boss and a second recess.

7. The cylinder head of an internal combustion engine according to claim 1, wherein said peripheral duct surrounding said inlet valve seat has a variable section around said inlet valve seat.

8. The cylinder head of an internal combustion engine according to claim 7, said section of said peripheral duct surrounding said inlet valve seat varies between 6 $mm^2$ and 21 $mm^2$ around said inlet valve seat.

* * * * *